US005135782A

United States Patent [19]

Rostoker et al.

[11] Patent Number: 5,135,782

[45] Date of Patent: Aug. 4, 1992

[54] METHOD OF SILICIDING TITANIUM AND TITANIUM ALLOYS

[75] Inventors: William Rostoker, Homewood; Gareth Rostoker, Glenwood, both of Ill.; Julius J. Bonini, Munster, Ind.

[73] Assignee: Rostoker, Inc., Burnham, Ill.

[21] Appl. No.: 622,949

[22] Filed: Dec. 6, 1990

Related U.S. Application Data

[63] Continuation-in-part of Ser. No. 365,245, Jun. 12, 1989, abandoned.

[51] Int. Cl.[5] ..... C23C 2/00

[52] U.S. Cl. ..... 427/435; 427/431; 427/432

[58] Field of Search ..... 427/435, 431, 432; 148/242, 279

[56] References Cited

U.S. PATENT DOCUMENTS 3,085,028 4/1963 Logan .
3,192,065 6/1965 Page et al. .
3,220,876 11/1965 Moeller .
3,397,078 8/1968 Anderson .
3,494,805 2/1970 Wang .

FOREIGN PATENT DOCUMENTS 290492 9/1965 Australia .
1312819 11/1962 France .
1388934 1/1965 France .

OTHER PUBLICATIONS

Coatings of High-Temperature Materials, H. H. Hausner, ed., ch. 4, Plenum Press, New York, 1966.

*Primary Examiner*—Shrive Beck
*Assistant Examiner*—Vi Duong Dang
*Attorney, Agent, or Firm*—Rockey and Rifkin

[57] ABSTRACT

Titanium and titanium alloy substrates are provided with a dense coating of a titanium silicide. The titanium silicide coating substantially increases the oxidation resistance of the substrate. The siliciding method includes the steps of: Forming a substantially molten pool of a siliciding alloy; contacting the substrate with the siliciding alloy; maintaining the substrate in contact with the siliciding alloy at a temperature at or above a minimum predetermined temperature to form a titanium silicide coating on the substrate; and separating the coated substrate from the siliciding alloy. The siliciding alloy includes a minimum effective concentration of silicon and a lithium metal flux.

9 Claims, 3 Drawing Sheets

METHOD OF SILICIDING TITANIUM AND TITANIUM ALLOYS

This is a continuation-in-part of application Ser. No. 365,245 filed Jun. 12, 1989, now abandoned.

BACKGROUND OF THE INVENTION

1. Field of the Invention

The present invention relates generally, to the field of metallurgy and more specifically to a method of forming a substantially uniform coating of a stoichiometric, titanium silicides over the surface of titanium and base alloys thereof.

2. Description of the Prior Art

Titanium is frequently used to fabricate structural or load-bearing members. Because of its relatively low density (about 0.16 lb. per cubic inch compared to about 0.28 for steel) it is often used in applications which require high strength, but where weight considerations are important, such as in the construction of aircraft. Because titanium is substantially nontoxic to humans and animals, it has also been extensively used in the construction of biomedical implants.

Titanium and titanium alloys do not exhibit good, high temperature oxidation resistance. It is well known that metallic titanium oxidizes very readily, even at room temperature at room temperature, metallic titanium quickly forms a thin oxide surface coating that is highly resistant to the diffusion of additional oxygen. The thin oxide surface coating is also very resistant to chemical attack. Unfortunately, at elevated temperatures the underlying metal will continue to rapidly oxidize. For this reason, titanium and its base alloys have generally been employed only in air or combustion gas environments where service temperatures are less than about 500° C.

Numerous attempts have been made to improve the oxidation and corrosion resistance of the titanium and titanium alloys and other metals. During the 1950's and '60's many methods were directed at forming a stoichiometric, metal silicide coating on substrates fabricated from the metals and base alloys thereof. The term "siliciding" will be used herein to broadly designate any process which accomplishes this result. These prior art siliciding methods generally employed the diffusion of elemental silicon into the substrate, at its surface. Specific examples of these prior art methods ar described below.

As used herein in connection with a metal or other element, the term "base alloy" means an alloy which is comprised of at least 50 weight percent of the designated metal or element. Consistent with convention (which is followed hereinafter unless otherwise indicated), such alloys are generally written in a form which does not specifically include the term "weight percent" in connection with the base metal or alloying constituents. As an example of this convention, the familiar aircraft alloy which comprises a titanium metal base, 6 weight percent aluminum and 4 weight percent vanadium is simply written Ti-6A1-4V;. Thus, Ti-6A1-4V is referred herein as a base alloy of titanium or a titanium-based alloy.

Also as used herein, the term "stoichiometric metal silicide," or "intermetallic silicide" means stoichiometric intermetallic compounds which exist in a binary alloy system between a particular metal and silicon. The intermetallic silicides (sometimes also referred to hereinafter simply as "metal silicides" or "silicides") exist as distinct crystalline phases, with no more than a narrow range of compositions about the stoichiometric proportion. A given metal-silicon alloy system may include several metal silicides of different stoichiometric relation. It will be understood by those skilled in the art that metal silicides may also exist in higher (ternary, quaternary etc.) alloy systems, so long as the metal and silicon are present in the required proportions and the crystal lattice assumes the requisite phase structure. As will be illustrated below in connection with the present invention, a titanium silicide coating (including a plurality of silicides) may be formed on a substrate fabricated from Ti-6A1-4V alloy. While the titanium silicide coating is comprised substantially of titanium silicides, the coating may also include vanadium and aluminum.

Several prior art attempts at siliciding the metals are reported in *Coating of High-Temperature Materials* (Samsonov, G. V., et al.; Hausner, H. ed; Plenum Press, New York 1966). A good deal of the work was carried out in the Soviet Union and involves the use of silicon tetrachloride, in a gaseous phase, as the silicon metal source. According to the siliciding theory, the gaseous silicon tetrachloride is reduced by hydrogen, which in turn causes the deposit of elemental silicon on the surface of the metal substrate. It is believed that the "metallic" silicon which is so-deposited, thereafter diffuses into the metal substrate and forms the desired metal silicide or silicides at the surface of the substrate. The process was reportedly carried out at temperatures between about 800° C. and 1200° C. on titanium, tantalum and molybdenum substrates. The starting components for generating the silicon tetrachloride and hydrogen were reported to include silicon powder mixed with three percent ammonium chloride.

The above process has several drawbacks, the most important of which is the presence of hydrogen. It is well known that at the reported temperatures, many metals, and particularly titanium, exhibit an extremely high solid solubility of hydrogen. It is also well known that very low concentrations of dissolved hydrogen can have a very detrimental effect on the mechanical properties of metals. In titanium, concentrations as low as 200–300 parts per million can induce brittleness and substantially reduce fatigue life. Thus, while the hydrogen reduction of silicon tetrachloride can provide a metal silicide coating on a metal substrate, the mechanical properties of the substrate may be severely affected.

Other prior art methods for siliciding metals have included "pack siliciding." In pack siliciding a metal substrate is surrounded by silicon powder (mixed with an inert separating compound) in a closed container. The entire container and its contents are then heated to and soaked at an elevated temperature so that the silicon diffuses into the metal substrate under solid state conditions. This method suffers from the drawback that the substrate must be subjected to diffusion temperatures for very long periods of time in order to form a silicide coating of appreciable thickness. Such a long term thermal excursion can adversely affect the microstructure of the metal and hence, its mechanical properties.

Furthermore, a dense silicide coating of substantially uniform thickness is not produced by solid state diffusion from a powder. The true area of contact between the surface of a substrate and a powder covering the substrate, is substantially less than the measured surface of that substrate. Because diffusion can occur only at the points of contact between the metal substrate and the silicon powder, the diffusion rate, as measured over the entire surface area of the substrate, is quite slow. In addition, as silicon diffuses into the metal substrate, the metal from the substrate diffuses into the silicon powder. This process produces a very porous silicide layer.

A general method of providing a coating on metals and alloys by diffusion is disclosed in French Patent No. 1,312,819. In this process a small amount of a coating material (generally between 10 and 1000 parts per million) in an alkali metal bath is used to coat the metal substrate, the only example of a silicide coating is molybdenum silicide formed on a molybdenum substrate.

The counterpart of the French Patent was U.S. Ser. No. 85,457 filed Jan. 10, 1961 and subsequently abandoned in favor of two continuation-in-part applications which matured into U.S. Pat. Nos. 3,192,065 and 3,220,876. In U.S. Pat. No. 3,192,065 the inventors disclosed that the molybdenum silicide formed by the process disclosed in the earlier process was of irregular thickness and varied performance lifetimes. They taught that it was necessary to dissolve at least one additive from the group carbon and tin in the bath.

French Patent No. 1,388,934 discloses the use of an alkaline earth metal such as calcium as a transfer agent to give diffusion alloy coatings on refractory metals. The diffusing elements are usually mixtures of aluminum and silicon. However, a 50% solution of silicon in calcium was used to give a multilayer coating on niobium.

Another disclosure of the use of a mixture of calcium and silicon to form a silicide diffusion coating is Australian Patent No. 290,492. The preferred amounts of silicon in the mixture are from 1% to 10%, and the mixture is used to coat steel.

It is clear that none of the references disclose a process directed to the rapid formation of a dense silicide coating of uniform thickness on titanium and its base alloys. We have discovered, surprisingly, that if titanium or its base alloys are contacted at the proper temperature with a molten alloy of lithium and silicon, containing at least about sixty weight percent of silicon, a dense silicide coating of uniform thickness is readily formed on the titanium or its base alloys.

SUMMARY OF THE INVENTION

It is therefore an object of the present invention to provide a method of siliciding substrates fabricated from titanium and base alloys thereof.

It is another object of the present invention to provide a method of siliciding titanium and titanium alloy substrates which does not substantially affect the microstructure of mechanical properties of the substrate in an adverse manner.

Another object of the present invention is to provide a method of forming an oxidation and corrosion-resistant coating on the surface of titanium and titanium alloy substrates.

Another object of the present invention is to provide a method of siliciding titanium and titanium alloy substrates which provides a silicide coating on the substrates that has higher hardness than the underlying substrates.

Yet another object of the present invention is to provide a method of siliciding titanium and titanium alloy substrates wherein silicon, from a reservoir that is maintained substantially molten, diffuses into the substrate which is maintained in the solid phase.

Still another object of the invention is to provide a method of siliciding titanium and titanium alloy substrates which provides a dense titanium silicide coating of substantially uniform thickness, regardless of the geometry of the substrates.

Still another object of the invention is to provide a method of siliciding titanium and titanium alloy substrates which does not introduce undesired solutes into the substrate.

These and other objects, features and advantages of the invention will become clear to those skilled in the art from the following drawings, descriptions and examples.

In accordance with the present invention a novel method of siliciding a titanium or titanium alloy substrate, is provided. The siliciding method of the invention comprises the steps of: forming a substantially molten pool of a siliciding alloy, which siliciding alloy includes at least about sixty weight percent silicon with lithium as a fluxing metal present in a predetermined proportion that renders the siliciding alloy substantially molten at a predetermined minimum siliciding temperature; contacting the titanium or titanium alloy substrate with the siliciding alloy at a temperature that is equal to or greater than the predetermined minimum siliciding temperature; maintaining the titanium or titanium alloy substrate in contact with the siliciding alloy, at a temperature which is equal to or greater than the predetermined minimum siliciding temperature, for a time sufficient to form a titanium silicide coating at the surface of the titanium or titanium alloy substrate; and separating the substrate containing titanium silicide coating from the siliciding alloy.

The silicon-based alloy pool and substrate are preferably maintained in an inert atmosphere.

DETAILED DESCRIPTION OF THE INVENTION

Various methods for contacting a titarium or titanium alloy substrate with a molten silicon-lithium siliciding alloy may be used. The only requirement is that the substrate remain in contact with the molten siliciding alloy for a time sufficient to form the desired silicide coating. One method for achieving the desired contact between the substrate and the siliciding alloy is described by reference to a drawing.

Figure 1:
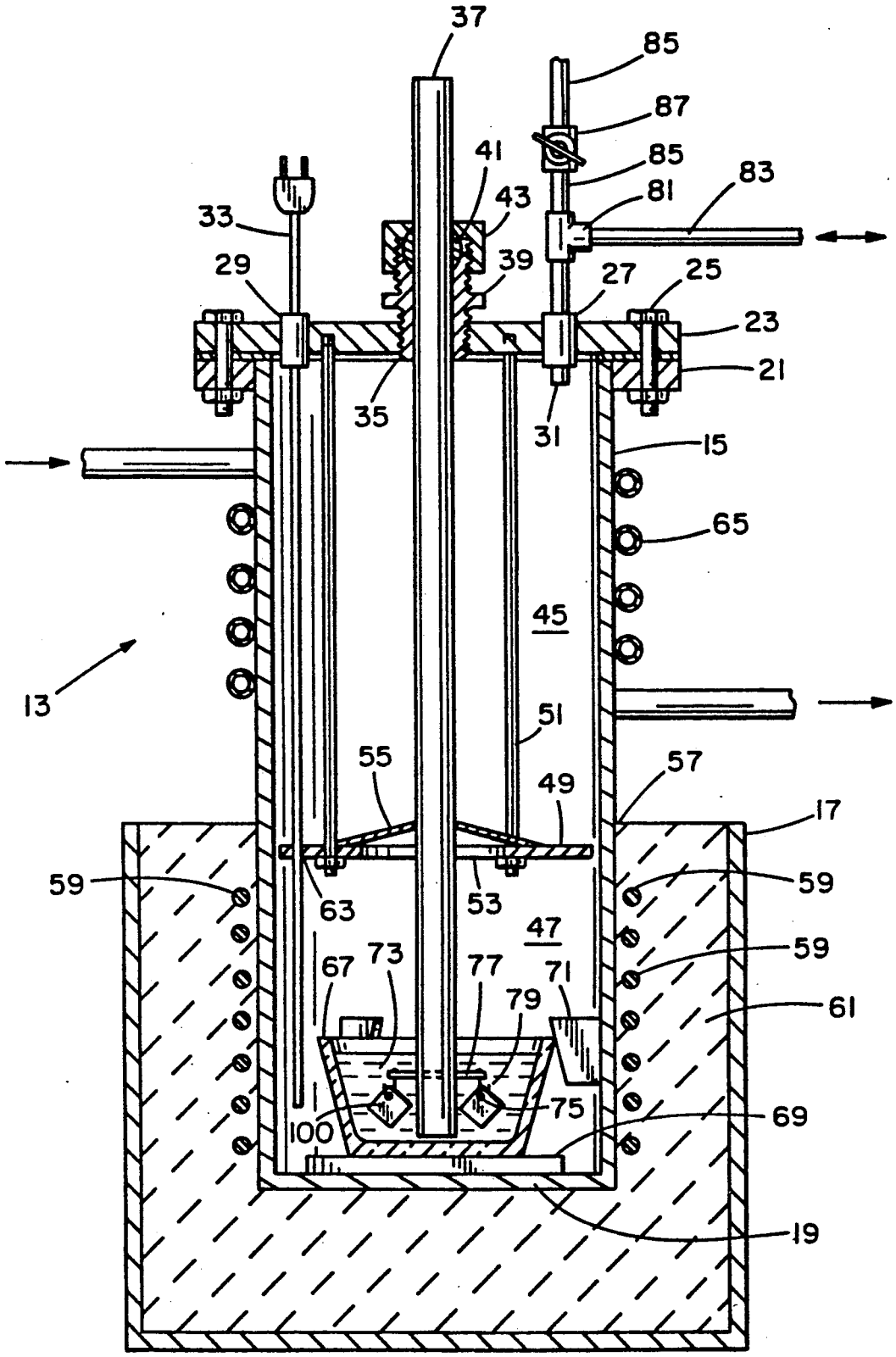
FIG. 1 is a front elevation of a retort and well furnace, shown in partial cross-section, which was used to practice the siliciding method of the present invention.

Referring now to the drawings, and in particular to FIG. 1, there is illustrated apparatus, generally indicated by reference numeral 13, which was used to practice the siliciding method of the present invention on titanium and titanium alloy substrates shown in the Figures. The apparatus 13 includes a retort 15 and heating means in the form of an electrical resistance well furnace 17.

The retort 15 is fabricated from four inch nominal diameter, schedule 40, 304 stainless steel pipe, closed at one end (bottom) by a one-quarter inch thick 304 stainless steel plate 19 welded thereto. The opposite end of the retort 15 has a flange 21 adapted for securing a sealable lid 23 to the top of the retort 15 by means of fasteners 25. The retort lid 23 is provided with apertures 27 and 29 which are adapted to receive gas conduit 31 and sheathed thermocouple 33, respectively. A third aperture 35 provides access to a specimen rod 37. Each aperture 27, 29 and 35 is made gas tight by virtue of a compression fitting 39 which includes a deformable ferrule 41 and a compression nut 43. For purposes of clarity, only the compression fitting 39 about specimen rod 37 is shown in the drawing.

Retort 15 is divided into a relatively cool zone 45 and a relatively hot zone 47 by a heat shield 49 suspended from sealable lid 23 by threaded rods 51. Heat shield 49 has a opening 53 formed at its center which permits the passage of specimen rod 37 therethrough. Means for closing the opening 53, such as a piece of tantalum foil 55, loosely wrapped about specimen rod 37 helps to maintain the temperature differential between zones 47 and 45.

The temperature in retort hot zone 47 is maintained by electrical resistance furnace 17 which receives the retort 15 in a well 57 and has heating elements at 59 surrounded by ceramic refractory material 61. The power input to heating elements 59 is controlled by a programmable, variable electrical power source associated with furnace 17 (not shown). The controller permitted the operator to set a predetermined temperature in well 57. After the predetermined temperature is reached, the controller causes furnace 17 to cycle on and off, thereby maintaining the temperature in well 57, and hence hot zone 47, substantially constant. The actual temperature in hot zone 47 is measured by thermocouple 33 which passes through a second, small opening 63 formed in heat shield 49.

The temperature in the retort cool zone 45 is maintained relatively cool by virtue of heat shield 49 and a water jacket 65, through which cooling water is circulated. Because the temperature in hot zone 47 is generally maintained between about 800° C. and 1000° C., cool zone 45 is provided to protect the integrity of the seal between sealable lid 23 and flange 21 and the seals about gas conduit 31, thermocouple 33 and specimen rod 37.

A crucible 67 is placed in the bottom of retort 15, in hot zone 47 on a mild steel block 69. Titanium metal wedges 71 secure the position of crucible 67 in the center of retort 15. A mild steel block 69 and titanium wedges 71 prevent reaction between crucible 67 and retort 15 during the siliciding cycle.

Crucible 67 is filled with a siliciding alloy 73 which alloy includes at least sixty weight percent silicon and lithium fluxing metal. Thus, the crucible 67 is preferably fabricated from a material such as titanium, which will not be adversely affected by contact with the siliciding alloy at siliciding temperatures. For purposes of conducting the siliciding experiments reported herein, it was found that a crucible machined from a round of commercially pure titanium withstood numerous experiments without undergoing failure. Likewise, specimen rod 37 must be fabricated from a suitable material such as titanium or tantalum.

For each siliciding experiment reported herein, the siliciding alloy 73 was prepared by mixing predetermined quantities of commercial quality lithium metal and powdered silicon in the crucible 67 and melting under a high purity (+99.995%) argon atmosphere. The lithium metal had a purity of 99 percent or better and the silicon powder had a purity of 99.9 percent or better.

It is preferable that the siliciding alloy be exposed to the crucible 67 for a substantial period of time prior to carrying out the siliciding method of the invention. This is because the crucible 67 presents a large surface area and initially depletes the siliciding alloy 73 of silicon until such time as a titanium silicide layer of substantial thickness is formed on the interior walls of the crucible. Thus, the siliciding method of the invention is preferably carried out on a "presilicided" crucible.

The bottom of specimen rod 37 is equipped with means for securing titanium or titanium alloy substrate specimens 100 thereto. As illustrated in FIG. 1, the titanium alloy substrate specimens 100 are provided in the form of coupons, each of which has a small hole 75 drilled therethrough. A small diameter tantalum rod 77 is transversely mounted through the end of specimen rod 37. Wires 79 fed through holes 75 and affixed to the ends of rod 77, permit titanium metal coupons 100 to be suspended in the siliciding alloy pool 73, without contacting the walls of the crucible 67. Thus, raising and lowering specimen rod 37 raises and lowers coupons 100 in and out of the siliciding alloy pool 73. The vertical position of the specimen rod 37 (and, therefore, the vertical position of coupons 100) can be fixed by tightening compression nut 43 which then holds specimen rod 37 in place. By this means, the titanium or titanium alloy substrate coupons 100 can be suspended directly over the siliciding alloy pool 73, the hot zone 47 of the retort 15.

Conduit 31 includes a "T" fitting 81 which receives conduit legs 83 and 85. Conduit leg 83 is alternately used to deliver pressurized argon gas from a regulated bottle or other source (not shown) and to draw a vacuum in retort 15. Conduit leg 85 includes a gas cock 87 and is used to bleed pressurized gas from the interior of retort 15.

In accordance with the invention, titanium or titanium alloy substrate coupons 100 were affixed to specimen rod 37 as illustrated in FIG. 1. Specimen rod 37 was raised and positioned so that the coupons 100 were suspended just above the crucible 67, but still within hot zone 47. The retort 15 was evacuated with a vacuum pump to a pressure of less than 500 microns of mercury and then back-filled with high purity argon gas The evacuation and argon back-fill was repeated on the cold retort, after which power was supplied to the well furnace 17. When the temperature in the hot zone 47 (as measured by thermocouple 33) reached about 200° C., the retort was once again evacuated and back-filled with argon. Thereafter, a slight positive pressure of argon gas was maintained in the retort 15 throughout the siliciding process to prevent the entry of air from any "leaks" which may have been present due to insufficient sealing of retort lid 23 or which were created by loosening compression nut 43 during movement of specimen rod 37.

After reaching a temperature equal to or greater than a predetermined minimum siliciding temperature in the hot zone 47, so that the siliciding alloy was substantially or fully molten, compression nut 43 was loosened and specimen rod 37 lowered so that titanium metal substrate coupons 100 were completely immersed in the alloy pool 73. Compression nut 43 was thereafter retightened and titanium metal substrate coupons 100 were left immersed in the siliciding alloy pool for a predetermined time ("immersion time"), while the temperature ("immersion temperature") in the hot zone 47 of the retort 15 was maintained at or above the predetermined minimum siliciding temperature. The titanium metal substrate coupons 100 were thus maintained in substantial thermal equilibrium with the alloy pool 73.

At the end of the immersion time, compression nut 43 was again loosened so that specimen rod 37 could be raised and substrate coupons 100 withdrawn from the siliciding alloy pool 73. The silicided substrate coupons 100 were suspended in the hot zone 47, directly over the siliciding alloy pool 73. This permitted excess siliciding alloy to drip off coupons 100 and return to the pool 73. After the titanium metal substrates 100 had been raised to this position, power to the furnace 17 was shut off, and the retort 15 (and its contents) were permitted to cool with the retort 15 positioned in well 57. After reaching near ambient temperature, the argon gas flow to the retort 15 was cut off, and the excess pressure bled therefrom by opening gas cock 87. Sealable lid 23 was removed and the silicided substrate coupons 100 were withdrawn from the retort 15.

In a modification of the foregoing procedure, the titanium metal substrate can be removed from the siliciding alloy pool 73 shortly after immersion. The siliciding is then completed by reaction between the substrate and adhering siliciding alloy while they are suspended in the hot zone 47.

Figure 2:
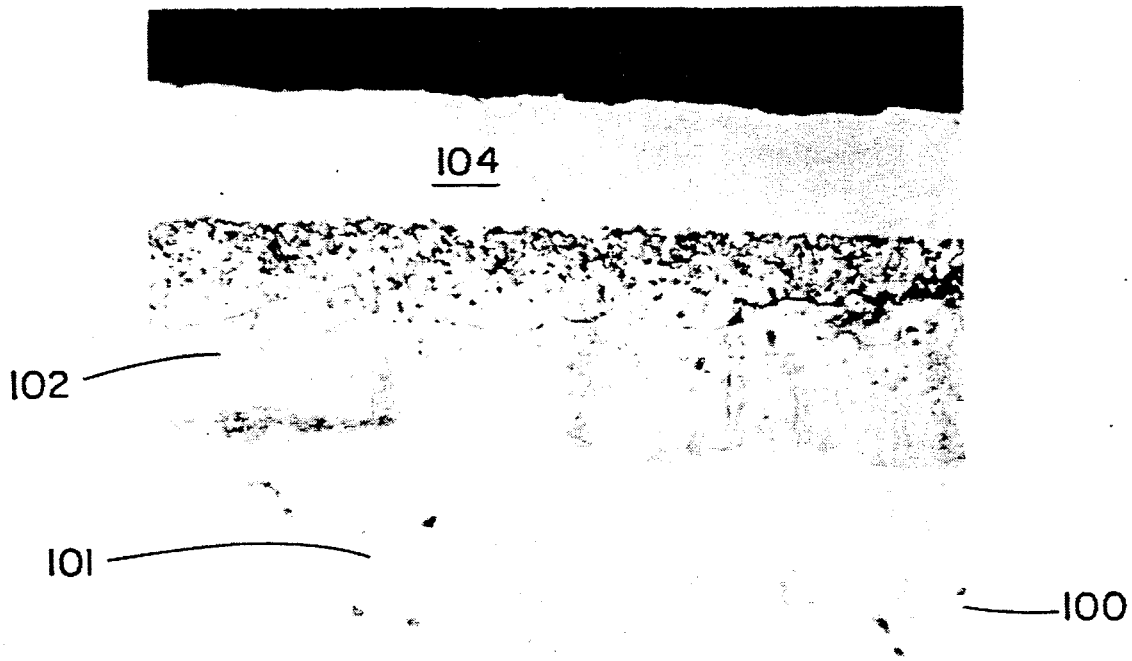
FIG. 2 is a photomicrograph (1000×) of a substrate fabricated from the alloy Ti-6A1-4V which was silicided in accordance with the present invention in a Si-15Li siliciding alloy for two hours at 900° C.

Referring now to FIG. 2, there is shown a photomicrograph of a Ti-6A1-4V alloy substrate coupon 100 which has been silicided in accordance with the above-described procedure. The Ti-6A1-4V substrate coupon 100 was immersed in the siliciding alloy Si-15Li for two hours at 900° C. A titanium silicide coating 102, about 30 microns thick, was formed at the surface of the Ti-6A1-4V; substrate. The unaffected underlying portion of the substrate coupon is designated with reference numeral 101.

After siliciding, the coupon 100 was prepared for metallographic examination employing the following steps. The coupon was first nickel-plated using an electroless nickel plating solution. After plating, the coupon 100 was sectioned in a direction transverse to the silicided surface, using a diamond saw and copious amounts of lubricant. The sectioned coupon was mounted, ground, polished and etched in accordance with standard metallographic practice. The use of the nickel deposit, over the silicided surface, was only for the purpose of preserving edge integrity. The nickel plate, being extremely hard, protected the integrity of the titanium silicide coating 102 during the polishing operations. The electroless nickel deposit used in the metallographic preparation is identified at 104.

The silicide coating 102 was found to comprise three distinct, stoichiometric titanium silicides. Energy dispersive spectroscopy revealed the presence of TiSi, $Ti_5Si_3$, and $TiSi_2$.

The thickness of the titanium silicide coating 102 (FIG. 2) was found to be very uniform over the surface of the substrate 100. In the field of electroplating, the ability of a plating bath to deposit a coating on the surface of a substrate inside holes and other recesses, or on concave surfaces, is referred to as the "throwing power" of the bath. The siliciding method of the present invention has been found to have infinite "throwing power". That is to say, a substantially uniform silicide coating can be formed over the entire surface of the substrate so long as the siliciding alloy is in contact therewith. A substantially uniform titanium silicide coating was found on the interior surfaces of "blind holes" (i.e., holes drilled only partially through a substrate) intentionally formed in other substrate coupons of Ti-6A1-4V alloy.

Figure 3:
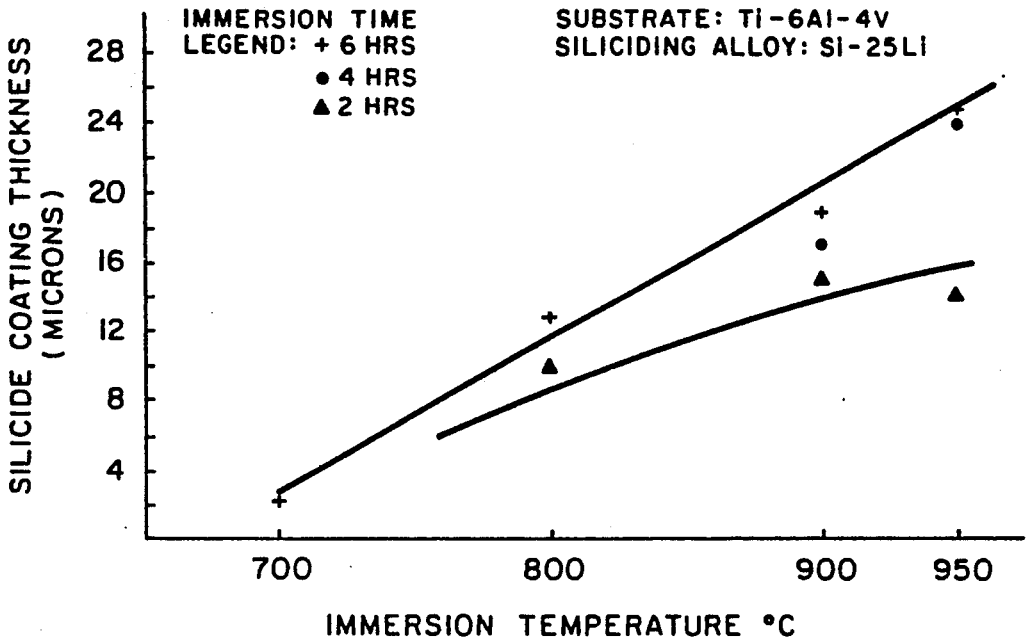
FIG. 3 is a graph which discloses the thickness of the silicide coating which forms on a Ti-6A1-4V substrate as a function of siliciding temperature, carried out for various times. A Si-25Li siliciding alloy was used to generate the data shown in FIG. 3.

FIG. 3 illustrates the effect of immersion time and immersion temperature on the thickness of the silicide coating which is formed on a titanium alloy substrate when silicided in accordance with the invention. A number of Ti-6A1-4V alloy substrate coupons were silicided in a Si-25Li siliciding alloy. The immersion time and the immersion temperature were varied for each coupon to generate the data plotted in FIG. 3. FIG. 3 clearly reveals that longer immersion times generate thicker silicide coatings for a given titanium substrate. The mathematical relationship between silicide coating thickness, immersion temperature and immersion time is unknown and most likely depends on a number of factors related to chemical activity. Thus, silicide coating thickness, as a function of immersion temperature and immersion time, is best determined empirically for any given titanium alloy substrate and siliciding alloy.

Figure 4:
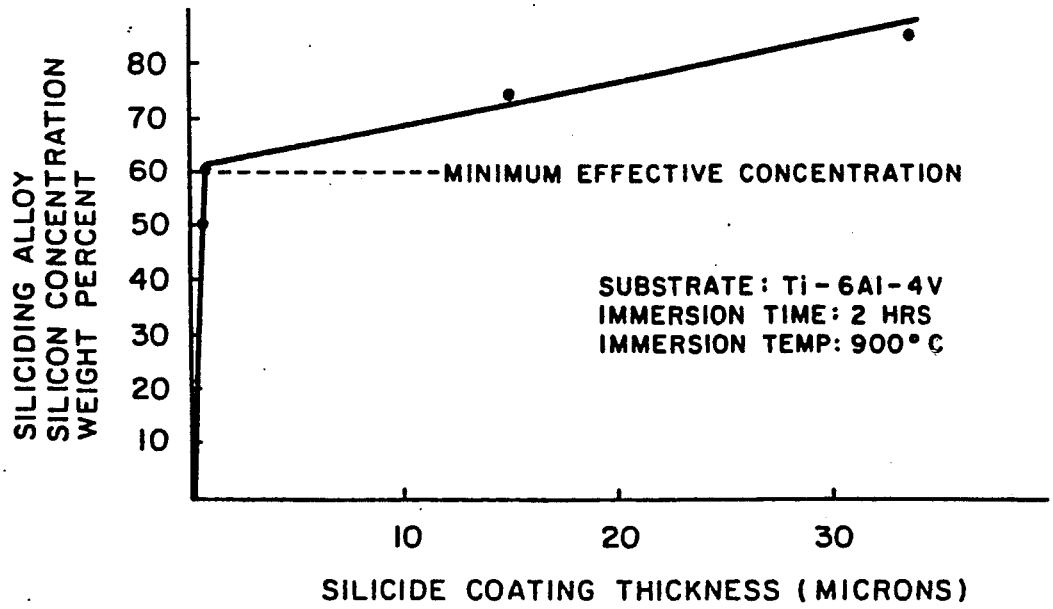
FIG. 4 is a graph which discloses the effect of silicon concentration (in the siliciding alloy) on the thickness of a silicide coating, which forms on a Ti-6A1-4V substrate after immersion in the siliciding alloy for two hours.

FIG. 4 discloses the relationship between silicon concentration in a siliciding alloy and the thickness of a silicide coating which forms on a titanium-based alloy substrate for a constant immersion time and immersion temperature. To generate the data in FIG. 4, several siliciding alloys, with varying silicon concentrations and a lithium metal flux, were prepared. Each of the different Si-Li siliciding alloys was then used to silicide a Ti-6A1-4V alloy substrate at 900° C. for a period of two hours. The thickness of the silicide coating which formed on each of the substrates was then metallographically determined. FIG. 4 clearly shows that the rate of formation of the titanium silicide coating dramatically increases when the concentration of silicon is at least about sixty weight percent in the siliciding alloy.

The results of FIG. 4 would suggest utilizing a siliciding alloy having the highest silicon concentration possible which is pure silicon. Nonetheless, siliciding in a molten bath of pure silicon is not possible. Pure elemental silicon has a melting point of 1414° C. In addition to the difficulties associated with working at temperatures in excess of about 1200° C. (i.e. the need for furnaces which have special refractories, etc.), titanium exhibits appreciable solubility in substantially pure, molten silicon. The use of the lithium metal flux in the siliciding alloy, permits the siliciding alloy to remain substantially molten at a much lower temperature. At this reduced temperature, the present inventors have observed that the solubility of the titanium is immeasurably small.

FIG. 3 discloses that for a given siliciding alloy, the thickness of the titanium metal silicide coating may be varied by controlling immersion time and immersion temperature. Furthermore, the coating thickness appears to be directly related, in a substantially linear manner, to these parameters. FIG. 4, however, discloses that for a given immersion time and immersion temperature, the thickness of the titanium metal silicide coating is related to the concentration of silicon in an unexpected, substantially non-linear manner. In other words, FIG. 4 defines a minimum silicon concentration at about 60 weight percent silicon, above which the rate of formation of the titanium silicide coating increases rapidly. That minimum concentration is referred to herein as the minimum effective concentration.

The results of the aforementioned siliciding experiments to determine the minimum effective silicon concentration and effect of immersion temperature and time are included in Table 1, below.

TABLE 1

| Siliciding Flux | Alloy wgt % Si | Immersion Temp °C. | Immersion Time (hrs) | Max. Silicide (Microns) |
|---|---|---|---|---|
| Li | 40.0 | 950 | 6 | 1.4 |
| Li | 50.0 | 900 | 2 | 0.7 |
| Li | 60.0 | 900 | 2 | 1.7 |
| Li | 75.0 | 950 | 6 | 27.0 |
| Li | 75.0 | 950 | 4 | 27.5 |
| Li | 75.0 | 900 | 6 | 23.0 |
| Li | 75.0 | 900 | 4 | 20.0 |
| Li | 75.0 | 900 | 2 | 15.0 |
| Li | 75.0 | 900 | 2 | 17.0 |
| Li | 85.0 | 900 | 2 | 40.0 |

Those skilled in the art will recognize that the mechanical properties of titanium and titanium alloy metals can be adversely affected by grain growth. Grain growth in the substrate, like the formation of the titanium silicide coating on the substrate, is proportional to both time and temperature. The present invention is therefore limited to those siliciding alloys wherein the silicon concentration is sufficiently high so that small increments in immersion time and immersion temperature can induce appreciable increments in the thickness of the titanium silicide coating. Thus, the long immersion times and high immersion temperatures required by the prior art methods, which can lead to unacceptable levels of grain growth, are avoided by the use of siliciding alloys wherein the weight %Si is maintained at or in excess of about 60%. It is clear then, that the minimum effective silicon concentration can be generally defined for siliciding alloys as being greater than or equal to about 60 weight %Si.

In addition to grain growth, high siliciding temperatures can also cause undesired allotropic changes in titanium and its base alloys. The Ti-6A1-4V alloy undergoes an allotropic transformation at about 980° C. (generally referred to as the beta transus temperature). Because Ti-6A1-4V alloy is usually purchased in a specially worked and heat-treated "mill" condition, reheating the product to a temperature in excess of the beta transus can destroy the desirably microstructure provided by the mill treatment.

Referring once again to FIG. 2, those skilled in the art will recognize that the microstructure of the substrate, below the silicide coating 102 (which region is designated by reference numeral 101), is substantially unchanged from the mill condition. That is to say, the microstructure at 101 does not reveal unacceptable levels of grain growth or that the Ti-6A1-4V alloy was subjected to a temperature in excess of the beta transus during the siliciding process.

It should also be noted that silicide coatings were successfully formed on substrates of unalloyed titanium, Ti-8A1-1Mo-1V, Ti-15Cr-3V-3A1-3Sn, Ti-14A1-20Nb and Ti-14A1-20Nb-3V-2Mo alloys. The composition of the titanium-based substrate alloy did not appear to affect the ability to form a silicide coating. Thus, the method of the invention is demonstrated as useful for forming a silicide coating on base alloys of titanium. Those skilled in the art will appreciate that the method of the present invention can also be practiced on composite material substrates which include a titanium metal or titanium metal alloy matrix.

Because the Ti-6A1-4V alloy is of great commercial importance, the oxidation resistance imparted to this material by the siliciding method of the invention was determined. Rectangular specimens having dimensions of about 50 mm×12.7 mm×1.6 mm thick were cut from commercial sheet. Half of the specimens were silicided in a Si-25Li alloy for two hours at 900° C., which produced a titanium silicide coating about 14 microns thick. All the specimens were then inserted into open-ended 26 mm diameter Vycor glass tubes. The specimens, contained in the glass tubes, were then rested on the hearth of an electrically heated box furnace. The box furnace was operated at a constant, predetermined temperature and a positive through-put of air to oxidize the specimens. In each instance, a pair of specimens was simultaneously oxidized under identical conditions for a given time. One of the specimens has been silicided as described above, in accordance with the invention. The other specimen was oxidized in its mill condition, as a control.

The specimens were furnace cooled to ambient temperature and the weight gain of each specimen was determined. Thereafter, the specimens were subjected to a 5T-guided bend test, with a fixed bent angle of about 90°. Those skilled in the art will recognize the guided bend test as a standard measure of ductility. The bend radius is expressed in multiples of sheet thickness, hence the 5T bend represents a bend radius of five times the specimen thickness. Whether the specimen bent or exhibited brittle fracture was recorded. Those specimens that bent were then examined under a low power magnification (10×) for evidence of embryonic crack formation. The terms "ductile bend" and "brittle bend" are used herein to respectively designate the absence or presence of crack initiation at the bend. The results of the oxidation and bend tests are presented below in Table 2.

TABLE 2

COMPARATIVE OXIDATION RESISTANCE OF Ti-6Al-4V

| | Mill condition | Silicide coated |
|---|---|---|
| **Furnace Temperature = 700° C.** | | |
| Time = 24 hours | | |
| weight gain (mg/cm$^2$) | not measured | not measured |
| 5T Bend | ductile bend | ductile bend |
| Time = 100 hours | | |
| weight gain (mg/cm$^2$) | 2.28 | 0.97 |
| 5T Bend | brittle bend | ductile bend |
| Time = 250 hours | | |
| weight gain (mg/cm$^2$) | 4.49 | 1.32 |
| 5T Bend | brittle bend | ductile bend |
| Time = 500 hours | | |
| weight gain (mg/cm$^2$) | 8.50 | 1.53 |
| 5T Bend | brittle bend | ductile bend |
| Time = 800 hours | | |
| weight gain (mg/cm$^2$) | 11.8 | 1.97 |
| 5T Bend | brittle bend | ductile bend |
| **Furnace Temperature = 800° C.** | | |
| Time = 24 hours | | |
| weight gain (mg/cm$^2$) | not measured | not measured |
| 5T Bend | brittle fracture | ductile bend |
| Time = 100 hours | | |
| weight gain (mg/cm$^2$) | 14.1 | 1.37 |
| 5T Bend | brittle fracture | ductile bend |

TABLE 2-continued

| COMPARATIVE OXIDATION RESISTANCE OF Ti-6Al-4V | | |
|---|---|---|
| | Mill condition | Silicide coated |
| Time = 250 hours | | |
| weight gain (mg/cm$^2$) | 33.5 | 2.09 |
| 5T Bend | brittle fracture | ductile bend |
| Time = 500 hours | | |
| weight gain (mg/cm$^2$) | 55.7 | 3.79 |
| 5T Bend | brittle fracture | ductile bend |
| Furnace Temperature = 900° C. | | |
| Time = 24 hours | | |
| weight gain (mg/cm$^2$) | not measured | not measured |
| 5T Bend | brittle fracture | ductile bend |
| Time = 120 hours | | |
| weight /gain (mg/cm$^2$) | 34.50 | 1.64 |
| 5T Bend | brittle fracture | ductile bend |
| Time = 303 hours | | |
| weight/gain (mg/cm$^2$) | 82.10 | 2.27 |
| 5T Bend | brittle fracture | ductile bend |
| Time = 516 hours | | |
| weight/gain (mg/cm$^2$) | 111.26 | 4.11 |
| 5T Bend | brittle fracture | ductile bend |

The dramatic increase in oxidation resistance imparted to Ti-6A1-4V alloy by the present intention is illustrated by the data reported in Table 2. Even at relatively modest temperatures (700° C.) the untreated Ti-6A1-4V alloy specimens began to exhibit brittle behavior after an exposure time as short as 100 hours. After 500 hours of exposure, the untreated Ti-6A1-4V alloy was reduced to a totally brittle condition. On the other hand, the Ti-6A1-4V alloy specimens which received a silicide coating in accordance with the invention, remained ductile even after exposure to a furnace temperature of 900° C. for 516 hours.

In addition to the guided bend test data, Table 2 reveals the weight gain of the Ti-6A1-4V alloy substrates under oxidizing conditions. The magnitude of the weight gain is a direct indication of the degree of oxidation. Comparing the weight gain data for mill condition and silicide coated Ti-6A1-4V alloy substrates, shows a drastic reduction in the oxidation rate which is imparted by the invention. It is therefore clear that the method of the invention can be employed to raise the service temperature for titanium and its base alloys, under oxidizing conditions.

Another distinct advantage is realized by utilizing the siliciding method of the present invention. The titanium silicide coating formed by the invention results in a substantial increase in hardness at the surface of the substrate. Ti-6A1-4V alloy sheet, in the common mill condition, has a hardness of approximately 360 on the Knoop scale. Hardness measurements performed on the titanium silicide coating 102 formed on the Ti-6A1-4V substrate illustrated in FIG. 2, yielded a result of 1120 on the Knoop scale, harder than most quenched and tempered tool steels. It is therefore expected that the method of the invention will increase the wear resistance as well as the oxidation resistance of titanium or titanium alloy substrates.

Titanium and its base alloys are well known for their tendency to gall. For this reason, these materials are frequently limited to service conditions wherein the material serves merely as a structural member, which is not subjected to sliding engagement with another surface. The increased surface hardness provided by the siliciding method of the invention may expand the application of these materials to components having bearing surfaces.

Finally, the siliciding method of the invention is advantageous in that it creates a dense, adherent silicide coating of modest thickness. For purposes of increasing oxidation resistance, a very thin coating of silicide will suffice. While the method of the invention has been used to form silicide coatings up to 100 microns thick, coatings in the range of about 5 to 30 microns provide substantial oxidation resistance and increased surface hardness with little weight increase.

The method of the invention, a method of siliciding titanium and titanium alloy, has been illustrated by various examples herein. These examples, and the preferred embodiments of the invention disclosed herein, are included for purposes of clarity and illustration. It will be apparent to those skilled in the art that various modifications, alternatives and equivalents of the method of the invention, and the apparatus used to practice the same, can be made without departure from the spirit of the invention. Accordingly, the scope of the invention should be defined only by the appended claims and equivalents thereof.

What is claimed is:

1. A method of siliciding titanium and titanium base alloy substrate, said method comprising the steps of:

forming a substantially molten pool of a siliciding alloy, which siliciding alloy consists essentially of at least about 60 weight percent silicon with lithium metal flux present in a predetermined proportion that renders said siliciding alloy substantially molten at a predetermined minimum siliciding temperature;

contacting the titanium or titanium base alloy substrate with the siliciding alloy at a temperature that is equal to or greater than the predetermined minimum siliciding temperature;

maintaining the titanium or titanium base alloy substrate in contact with the siliciding alloy, at a temperature which is equal to or greater than the predetermined minimum siliciding temperature, for a time sufficient to form a titanium silicide coating between about 5 microns and about 30 microns thick at the surface of the titanium or titanium base alloy substrate; and separating the substrate containing the titanium silicide coating from the siliciding alloy.

2. A method of siliciding titanium and titanium base alloy substrates in accordance with claim 1 wherein said titanium silicide coating forms as a dense layer, of substantially uniform thickness over the surface of said titanium or titanium alloy substrate.

3. A method of siliciding titanium and titanium base alloy substrates in accordance with claim 1 wherein said substrate is Ti-6A1-4V alloy.

4. A method of siliciding titanium and titanium base alloy substrates in accordance with claim 1 wherein said substrate is unalloyed titanium.

5. A method of siliciding titanium and titanium base alloy substrates in accordance with claim 1 wherein said siliciding alloy is fully molten at said temperature at which said substrate is maintained in contact with said siliciding alloy.

6. A method of siliciding titanium and titanium base alloy substrates in accordance with claim 1 wherein said titanium silicide coating improves the oxidation resistance of said titanium or titanium base alloy metal as compared to said titanium or titanium base alloy in an untreated condition.

7. A method of siliciding titanium and titanium base alloy substrates in accordance with claim 1 wherein said titanium silicide coating is harder than the underlying, unaffected substrate metal.

8. A method of siliciding titanium and titanium base alloy substrates in accordance with claim 1 wherein said minimum siliciding temperature is about 700° C.

9. A method of siliciding titanium and titanium base alloy substrates in accordance with claim 1 wherein the siliciding alloy and substrate are maintained in an inert atmosphere.

* * * * *